United States Patent [19]

Geri

[11] 3,934,507

[45] Jan. 27, 1976

[54] MERCHANDISE LABEL MARKING GUN

[75] Inventor: Don W. Geri, Mountain View, Calif.

[73] Assignee: Primark Corporation, Dublin, Calif.

[22] Filed: Oct. 9, 1973

[21] Appl. No.: 404,486

[52] U.S. Cl. ..... 101/291; 156/384; 101/295

[51] Int. Cl.[2] ..... B41F 1/08

[58] Field of Search.... 101/288, 290, 291, 292–295; 156/384, 577

[56] References Cited

UNITED STATES PATENTS

| | | | |
|---|---|---|---|
| 3,330,207 | 7/1967 | De Mar | 101/288 X |
| 3,440,123 | 4/1969 | Hamisch | 156/384 |
| 3,611,929 | 10/1971 | Schrotz et al. | 101/292 |
| 3,656,430 | 4/1972 | Olsson | 101/292 X |
| 3,782,279 | 1/1974 | Carboni et al. | 101/288 |

*Primary Examiner*—Edgar S. Burr
*Assistant Examiner*—E. M. Coven
*Attorney, Agent, or Firm*—Limbach, Limbach & Sutton

[57] ABSTRACT

A marking gun for printing adhesive labels with pricing and the like having a printing head directly connected to an operating trigger for impressing the labels, a drive wheel is linked to the operation trigger by a ratchet and pawl assembly for incremental advancing of the labels carried on a backing tape, the tape being transported by radial drive teeth which engage perforations in the backing tape, separation of the labels from the tape being aided by a cam operated pressure shoe, and threading of the tape through the gun being aided by a retractable spring biased guide member which holds the backing tape against the drive wheel during operation, and guides the tape around the drive wheel during threading when retracted by a thumb trigger that projects from the casing of the marking gun.

7 Claims, 7 Drawing Figures

MERCHANDISE LABEL MARKING GUN

BACKGROUND AND SUMMARY OF THE INVENTION

Mass marketing of retail goods requires the repetitious marking of individual items with price or other information. Marks may either be directly stamped on the goods or first imprinted on adhesive labels and the labels affixed to the goods. The subject marking tool is of the latter category and contains a supply of adhesive labels and a printing head with a variety of selectable characters which may be impressed on the labels.

Although numerous marking tools of this type are presently available, they are cumbersome and expensive. A primary problem in constructing a label marker is in accurately advancing the labels to printing position. Some devices employ friction drive rollers to advance labels. However, when the rollers pull on silicone coated backing tape of the adhesive labels, silicone eventually coats the rubber rollers and the rollers cease to operate properly. Other devices employ conveyer belts or shuttle mechanisms to advance the labels but the very complexity of these mechanisms often leads to their high cost and inefficiency.

The subject marking tool carries a supply of adhesive labels in a molded plastic casing having a pistol grip and trigger. The trigger is directly connected to the printing head by a long pivot arm. Connected to the pivot arm by a ratchet and pawl assembly is a tape drive mechanism which advances the labels by engaging drive teeth in perforation slits in the backing tape of the adhesive labels. The positive drive mechanism for advancing the tape insures that the printing head properly marks each label without drifting.

The positive drive mechanism to which the present improvements relate is described in the application of William Martin, entitled "Merchandise Marking Gun," Ser. No. 361,480, filed May 18, 1973, now U.S. Pat. No. 3,800,701, and continued from an application of the same title, Ser. No. 134,346, filed on Apr. 15, 1971, (now abandoned) and assigned to the assignee of the present application.

This invention relates to an improved drive mechanism having a cam operated pressure shoe for controlled tension in the backing tape and a retractable guide member which when engaged maintains the backing tape against the drive wheel in engagement with the drive teeth and when retracted allows the backing tape to be threaded around the drive wheel.

The cam operated pressure shoe is selectively depressed against the label tape on a printing guide plate during label transport to impart a momentary increase in tension in the backing tape at the point a label approaches a sharp reverse or switchback in the direction the backing tape advances through the marking gun. This temporary increased tension materially aids the separation of the label from the backing tape and is particularly effective when the label has lost its original stiffness through absorption of atmospheric moisture.

Additionally, the cam system allows the use of tamper proof labels with partial cross cuts that cause tearing of the label when an attempt is made to remove the label from the article to which is is attached. Such tamper proof labels require a more controlled handling by a transport mechanism to prevent jamming of these sensitive labels in the marking gun caused by incomplete separation from the backing tape.

The retractable guide member comprises a guide member which maintains the backing tape against the drive wheel such that the teeth pass through perforations in the backing tape. Since the marking gun of the type described is used by general clerical personnel, threading of the tape when replacing an exhausted roll must be accomplished quickly and easily without the use of tols. To facilitate threading, the guide member is retracted from the drive wheel by a thumb trigger which projects through the casing of the marking gun for threading of the tape without interference by the drive teeth.

DETAILED DESCRIPTION OF THE PREFERRED EMBODIMENT

Figure 1:
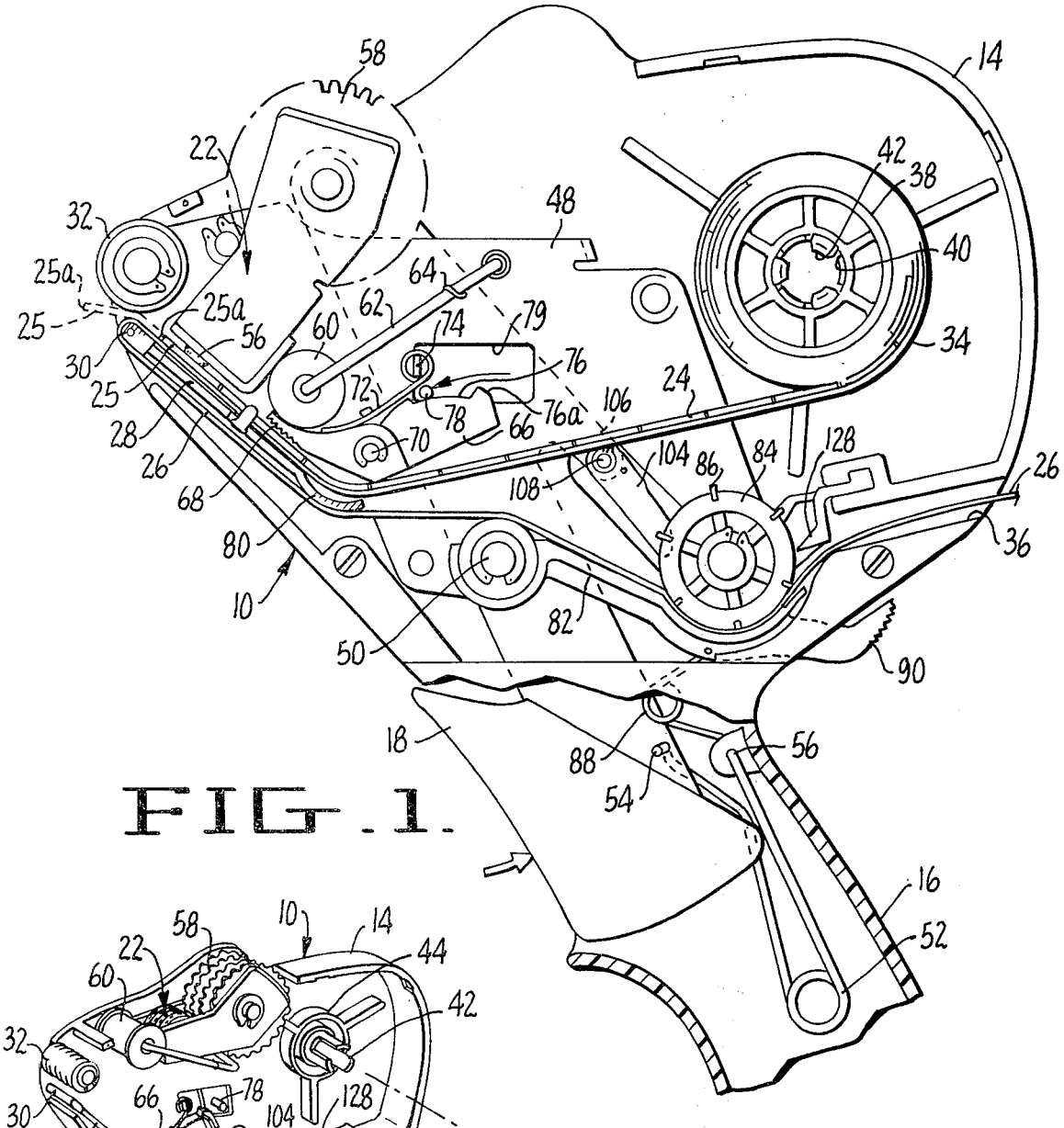
FIG. 1 is an elevational view, partially in cross-section, of the marking gun with a side cover removed.
Figure 2:
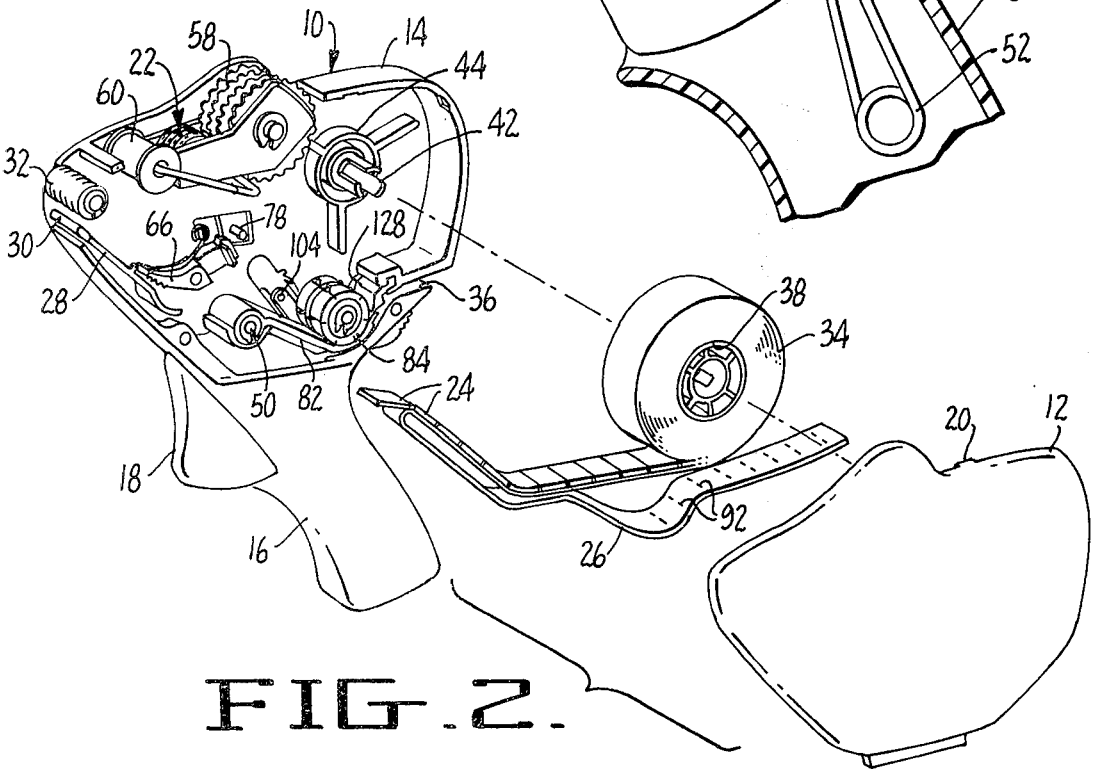
FIG. 2 is an exploded view of the marking gun and tape supply.

Referring to FIGS. 1 and 2, the marking gun 10 is illustrated with a side access cover 12 removed to reveal the internal elements of the drive mechanism. The marking gun has a molded outer casing 14 with a pistol grip handle 16 and operating trigger 18. With the cover snapped into place by flexible tabs 20 (one shown in FIG. 2), the unit comprises a compact enclosed marking tool that is simple to operate. When the trigger 18 is squeezed as shown in FIG. 1, a printing head 22 impacts on a label 24 carried on a separable backing tape 26 which in the area of printing is oriented and supported against a printing guide plate 28. When the trigger 15 is released, the printed label is partially emitted between a guide tip roller 30 and an applicator roller 32. By lightly pressing the applicator roller 32 to the item to be labeled and downwardly moving the marking gun 10, the marked label is removed from the gun and rolled onto the item.

The marking labels 24 have an adhesive on one side which retains the label on the backing tape 26. However, the backing tape is silicone coated to allow separation of the label from the tape. When the tape is sharply reversed in direction around the guide tip roller, the relatively stiff precut labels are unable to negotiate the switchback and thereby partially separate from the backing tape instead of following the backing tape around the roller. When rolled onto an item by pressure from the applicator roller, the label adheres to the item and separates completely from the backing tape and is removed from the marking gun.

The exploded view of FIG. 2 and the view of FIG. 1 depict the path that the adhesive labels 24 and backing tape 26 traverse as they unwind from a storage roll 34 which stores a supply of labels within the marking gun. While the labels 24 are emitted between the two rollers, the backing tape 26 continues through the gun to exit from a slot 36 at the back of the gun above the handle 16.

The tape storage roll 34 is carried on a plastic core 38 which includes three asymmetrically arranged slots 40 to fit over a three-pronged flange 42 at the end of a support spindle 44. The prongs of the flange are flexible and flared slightly outwardly to provide a slight drag to the core when the core is rotated thereby imparting a tension to the tape during operation as described in greater detail in copending application entitled "Merchandise Marking Gun," Ser. No. 361,480, filed May 18, 1973, referred to above. In this manner, the likelihood of the roll 38 falling off the spindle when the cover is removed is remote since the slots 40 and three pronged flange must be precisely mutually aligned.

Referring again to FIG. 1, the trigger 18 is attached to a long rigid pivot arm 46 which directly connects the printing head 22 to the trigger. The pivot arm partially shown in phantom in FIG. 1 is partially concealed by a rigid plate 48 which provides a support base for the principal drive elements in the marking gun. Mounted on the plate is a pivot pin 50 on which the pivot arm pivots. The pivot arm 46 is spring biased to a preoperative position by a spring 52 located in the handle 16 and attached at one end 54 to the pivot arm and at the other end to the casing 14. At the distal end of the pivot arm 46 is the printing head 22 which contains a plurality of printing characters 56 which are selectable by rotation of selection wheels 58 in a conventional manner. The characters are inked by an inking roller 60, which is positioned above thhe characters in the preoperative position of the printing head as shown in FIG. 2, and is rolled across the characters during traversal of the printing head and positioned below the printing head in the printing position as shown in FIG. 2. The inking roller 60 is porous containing a supply of ink and is displaceable in coordination with the displacement of the printing head by a pivoting inker arm 62 on which it is carried. The arm 62 is biased to the preoperative position by a spring clip 64 connected to the arm.

Of particular importance and the elements comprising the positive drive mechanism which insure that the backing tape is incrementally advanced for accurate positioning such that the individual labels are properly marked.

Considering again the path of the adhesive labels 24 and backing tape 26 from the supply roll 34, the tape and labels unwind from the bottom of the roll and pass under a spring biased guide 66. The guide 66 includes a pressure shoe 68 with a serrated surface which maintains the backing tape and labels against the printing guide plate 28 as shown in FIG. 1. The spring biased guide 66 is pivoted on a pin 70 and is biased by a spring 72 connected to a tab 74 in the mounting plate 48. The guide 66 is pivoted by a cam surface 76 which engages a pin 78 fixed to the rigid pivot arm 46. The pin 78 projects through an opening 79 in the mounting plate and moves from the preoperative position shown in FIG. 3 to the printing position shown in FIG. 1.

The cam surface 76 is designed to operate by close cooperation with the transport of the labels. During the printing stroke, the backing tape 26 and labels 24 are not transported and the effect of the pin 78 on the cam surface 76 and pressure shoe 68 is of marginal importance, the shoe operating to generally maintain the tape in position until the printing head 22 contacts and prints a label, for example, label 25 shown in FIG. 1. In the position shown in FIG. 1, the pressure shoe 68 is raised slightly from the tape and labels.

As the trigger is released and the drive mechanism commences to advance the backing tape 26 and labels over the guide plate 28, the pressure shoe 68 by design of the cam surface descends on the tape and labels exerting a maximum pressure against the tape just after the lead edge 25 of the printed label 25 has reached the forward edge of the guide tip roller 30 at the end of the plate 28. At this point, the pressure shoe forces any slack in the tape between the pressure shoe and a drive wheel 84 to be taken up and thereby imparts an increased tension in the tape. The guide tip roller 30, the guide plate 28 and additional guides described hereafter which direct the sharp reversal in the direction the tape is transported provide the basic guide means for separating the printed label from the backing tape.

As the tape advances, the pressure shoe is momentarily retracted as the pin 78 moves over a terminal projection 76*a* on the cam surface. This momentary retraction allows the supply roll to advance under direct metering by the drive mechanism.

As the advance of the label approaches its termination, the pin 78 rides down the terminal projection 76*a* and again exerts full pressure on the labels and tape. This tension aids in further separation of the label from the tape and leaves the printed label 25 projecting from the top of the marking gun as shown in phantom in FIG. 1. The label is then in a position to be rolled onto an article to be labeled.

For labels of greater length then those shown in the preferred embodiment, the cam surface may be designed to intermittently retract the shoe at one or more points to provide periodic tension relief during separation of the printed label from the tape.

After the backing tape 26 without labels switches back around the guide tip roller 30, the tape is deflected by a free end 80 of the printing guide plate 28. The printing guide plate 28 is formed by bending a portion of the fixed mounting plate 48. A part of the guide plate 28 is undercut to allow the free end 80 to be manually deformed to permit adjustments to be made in the tape path.

From the free end of the guide plate, the backing tape passes over the pivot pin 50 for the pivot arm 46 and is guided by retractable spring biased guide member 82 around a tape drive wheel 84. The drive wheel 84 includes a plurality of symmetrically arranged drive teeth 86 which engage perforations in the backing tape for advancing the tape in the marking gun. Since the drive wheel 84 is spacially displaced from the area of printing on the guide plate 28, the positioning of labels is determined by the effective length of the tape path between the printing guide plate 28 and the drive wheel. This effective length is adjustable by deformation of the free end 80 of the guide plate, which deflects to a greater or lesser extent the backing tape after passing around the guide tip roller 30. In this manner, by adjustment of the free end 80, the printing characters 56 on the printing head 22 can be properly centered on the labels. Once an initial adjustment is made, centering will generally be maintained for the life of the marking gun for uniform supplies of labels and backing tape.

The retractable guide member 82 is spring biased against the drive wheel 84 by a spring 88, such that the backing tape is firmly maintained against the drive wheel in engagement with the drive teeth 86. Since the drive teeth will interfere with initial threading of the backing tape from a new supply roll, the guide member 82 is retracted from the drive wheel by displacement of an integral thumb trigger 90 at the end of the guide member 82. The thumb trigger 90 projects through the casing 14 for convenient operation and is displaceable in the direction indicated in FIG. 3. The guide member 82 is pivotally connected to the pivot pin 50 and swings away from the drive wheel when the thumb trigger 90 is displaced. The backing tape can then easily be threaded around the drive wheel and adjusted such that the drive teeth project through perforations in the backing tape. The perforations comprise pairs of spaced slits 92 in the center of the backing tape which are visible in the explosed view of FIG. 2.

Figure 3:
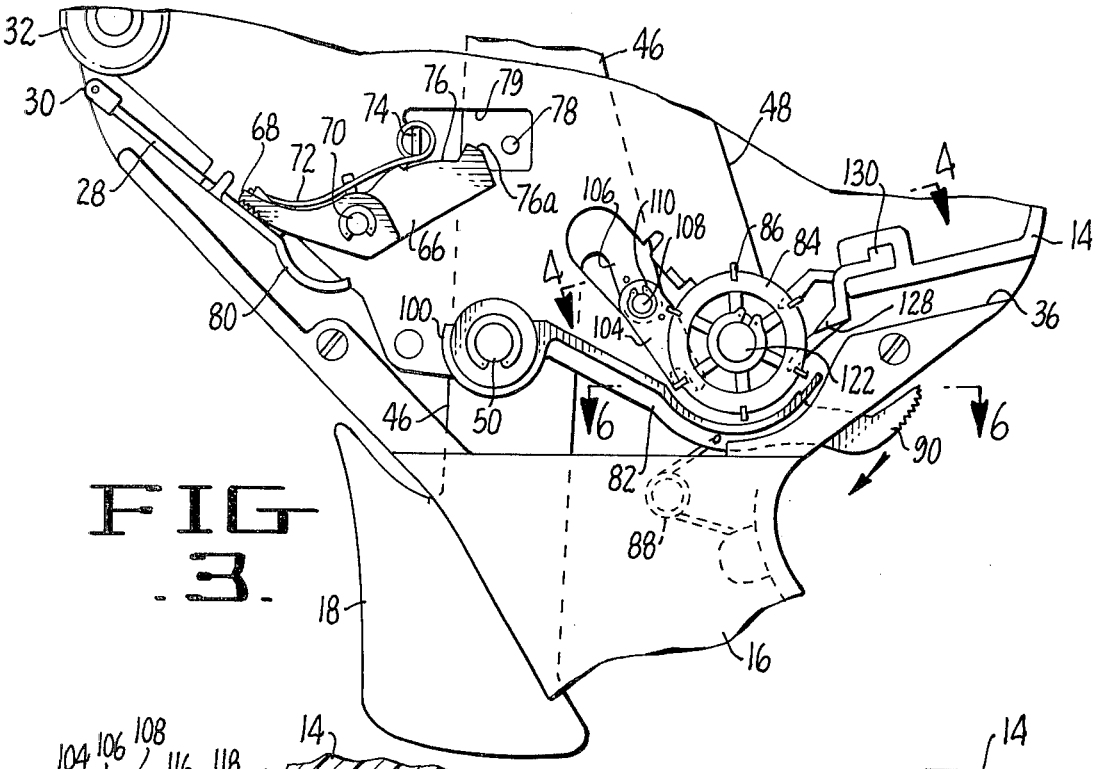
FIG. 3 is an enlarged fragmentary view of the marking gun with side cover removed.
Figure 4:
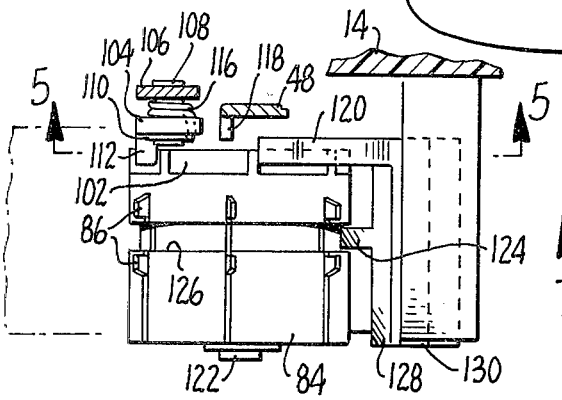
FIG. 4 is a cross-sectional view taken on the lines 4—4 in FIG. 3.
Figure 6:
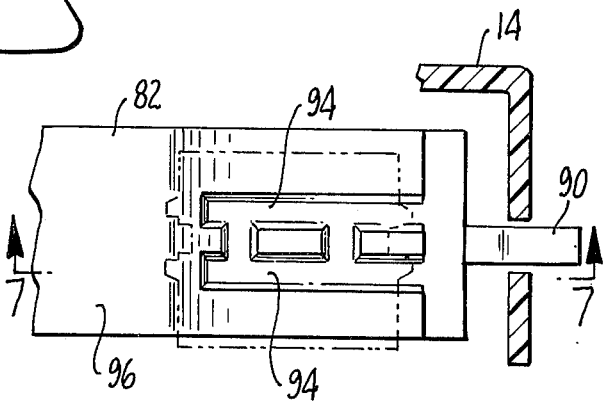
FIG. 6 is a cross-sectional view taken on the lines 6—6 in FIG. 3.

Referring to FIGS. 3, 4, 6 and 7, the cooperation between the drive wheel 84 and the retractable guide member 82 is illustrated. The radial drive teeth 86 project from the drive wheel 84 and are arranged in spaced pairs as shown in FIG. 4. To allow the guide member 82 to maintain the backing tape against the surface of the drive wheel, the guide member is provided with recessed channels 94 as shown in FIG. 6 which provide a clearance for passage of the drive teeth 86 as shown in the cross sectional view in FIG. 7. The configuration of the guide member is designed to provide a contoured member that can be fabricated from plastic with sufficient strength and stiffness to function reliably. Thus, while the main portion of the guide member 82 comprises a contoured flat surface 96, a central rib 98 which in part forms the thumb trigger 90 adds to the overall strength of the member. For convenience, connected ends 100 of the guide member do not completely encircle the pivot pin 50 such that the end 100 can be snapped on the pin during assembly of the gun.

Figure 5:
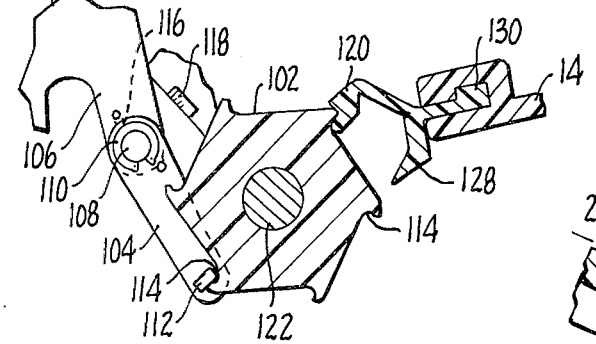
FIG. 5 is a cross-sectional view taken on the lines 5—5 in FIG. 4.
Figure 7:
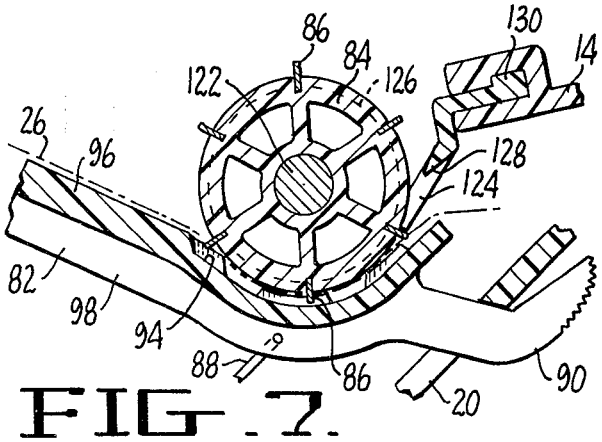
FIG. 7 is a cross-sectional view taken on the lines 7—7 in FIG. 6.

The drive wheel 84 is directly linked to the pivot arm 46 and hence to the printing head 22 and trigger 18 by a ratchet and pawl assembly shown clearly in FIGS. 1, 3, 4 and 5. A ratchet wheel 102 comprises an integral part of the drive wheel 84 as shown in FIG. 4. A pawl 104 is pivotally connected to a finger extension 106 of the pivot arm 46 by a pin 108 and retainer clip 110 as shown in FIGS. 3 and 5. The pawl 104 includes a foot 112 at the distal end which incrementally engages one of a plurality of seats 114 on the drive wheel as shown in FIG. 5.

When the trigger 18 is squeezed as shown in FIG. 1, the pawl 104 moves to the position shown. The foot 112 of the pawl 104 snaps in engagement with the next adjacent seat of the ratchet wheel by bias from a coil spring 116 wrapped around the pin 108 and fixed at one end to the pawl 104 and at the other end to the finger extension 106 as shown in FIG. 5. Overshoot of the pawl is prevented by stop 118. A flexible plastic detent 120 prevents the drive wheel from backwardly rotating while the pawl 104 is disengaged from the ratchet wheel by engaging a seat 114 of the ratchet wheel as shown in FIG. 5. The flexible plastic detent 120 essentially forms a pawl which is spring biased by its inherent flexibility to trip over each seat and engage the next adjacent seat with each incremental rotation of the drive wheel.

When the trigger is released the drive wheel is rotated an increment on a spindle 122 transporting the backing tape the distance of a single label. Since the drive teeth 86 on the drive wheel firmly engage the backing tape through the perforation strips, it is necessary to peel the backing tape away from the drive wheel and guide it out the exit slot 36 in the casing 14 as shown in FIG. 1. This is accomplished by an elongated member 124, shown in FIG. 7, which extends into a circumferential channel 126 in the center of the drive wheel 84 betwen the spaced pairs of drive teeth 86 as shown in FIG. 4. In this manner, the elongated member 124 projects under the backing tape and lifts it from the surface of the drive wheel as the drive wheel rotates. Guiding is aided by a flat projection 128 adjacent the exit slot 36 as shown in FIG. 3.

The flexible detent 120, the elongated member 124 and the flat projection 128 are all fabricated from a single plastic member which is anchored in a molded slot 130 in the casing 14.

The operation of the marking gun is remarkably simple. When the trigger is squeezed, a label is printed and partially ejected. The label could then easily be applied to an article by the applicator roller. However, it was experienced that operators of a device substantially identical to the present device had difficulty replacing an exhausted tape supply roll with a new roll, particularly in feeding or threading the end of the tape through the marking gun. The problem was largely caused by spring biased guides, one which maintained the tape against the printing plate, and most significantly one which maintained the tape against the drive wheel. By arranging these guides such that they are retractable from the tape path, the tape can be threaded with relative ease. This is accomplished by the cam operated pressure shoe and the thumb operated guide member as described above. By manipulating the printing trigger, the pressure shoe can be displaced from the printing plate and by operating the thumb trigger attached to the guide member, the member can be displaced from the drive wheel. In these positions, the tape has a substantially unobstructed path through the marking gun.

What is claimed is:

1. In an adhesive label printer having a printing head operably connected to an operating trigger, a casing, a drive assembly contained within the casing and adapted to incrementally transport a label tape having precut adhesive labels carried on a separable backing tape, and a printing plate on which individual labels are sequentially printed by said printing head and incrementally advanced by said drive assembly in a direction across said printing plate, said printing plate having a cooperating label separating means for sharply reversing the direction of the backing tape for separating printed labels from the backing tape, each label having a lead edge that is first separated from the backing tape at the label separating means, an improvement comprising:

pressure means adapted to engage said tape upstream from said label separating means and bias means urging said pressure means against the tape at each incremental advance and releasing after each separation, said bias means cooperatively engaged to said trigger, whereby the backing tape passes the label separating means under sufficient tension to separate a label from the backing tape.

2. The adhesive label printer of claim 1 wherein said pressure means for imparting increased tension in said backing tape comprises a pressure shoe and said bias means comprises a spring.

3. The adhesive label printer of claim 2 wherein said spring is opposed by a retraction means for selectively retracting said shoe from said guide member, said retraction means comprising a cam operatively connected to said shoe, said cam engaging a cam follower in said drive assembly to increase tension on the backing tape when printed labels are in a position to be separated from the tape.

4. The label printer of claim 1 wherein said casing includes a pistol grip handle, said trigger being arranged with respect to said handle for finger operation and said guide member having a distal end arranged with respect to said handle for thumb operation.

5. The adhesive label printer of claim 1 wherein said means for retracting the guide member from the drive wheel comprises a distal end integral with said guide member said distal end projecting through said casing for manual operation of said guide member from an engaged position to a retracted position.

6. The adhesive label printer of claim 1 wherein the backing tape has spaced perforations and the drive assembly includes a cylindrical drive wheel operably connected to the operating trigger for incremental advance of the backing tape, the cylindrical drive wheel having a peripheral surface with radially disposed drive teeth arranged to engage the spaced perforations in the backing tape, and a retractable guide member having means for maintaining the backing tape against the drive wheel in engagement with the drive teeth and means permitting retraction of the guide member from the drive wheel for threading the backing tape around the drive wheel without engaging the drive wheel.

7. The adhesive label printer of claim 1 wherein said bias means has two positions, a first position normally at rest out of contact with the label tape and a second position urging the pressure means to engage the tape only when separating labels from backing tape.

* * * * *